US009605644B2

(12) United States Patent
Huberts et al.

(10) Patent No.: US 9,605,644 B2
(45) Date of Patent: Mar. 28, 2017

(54) DUAL COIL IGNITION SYSTEM

(71) Applicant: Ford Global Technologies, LLC, Dearborn, MI (US)

(72) Inventors: Garlan J. Huberts, Milford, MI (US); Qiuping Qu, Troy, MI (US); Michael Damian Czekala, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 966 days.

(21) Appl. No.: 13/912,073

(22) Filed: Jun. 6, 2013

(65) Prior Publication Data

US 2014/0360476 A1 Dec. 11, 2014

(51) Int. Cl.

| | |
|---|---|
| ***H01F 27/28*** | (2006.01) |
| ***F02P 9/00*** | (2006.01) |
| ***F02P 3/04*** | (2006.01) |
| ***H01F 38/12*** | (2006.01) |
| *F02P 3/045* | (2006.01) |

(52) U.S. Cl.

CPC ..... *F02P 9/002* (2013.01); *F02P 3/04* (2013.01); *H01F 38/12* (2013.01); *F02P 3/0453* (2013.01)

(58) Field of Classification Search

CPC .. F02P 9/002; F02P 3/04; F02P 3/0453; F02P 3/0456; H01F 38/12

USPC ..... 123/620, 621, 637

See application file for complete search history.

(56) References Cited

U.S. PATENT DOCUMENTS

| | | | | |
|---|---|---|---|---|
| 3,760,782 | A | 9/1973 | Meyer et al. | |
| 3,885,541 | A * | 5/1975 | Hufton | F02P 1/086 123/598 |
| 4,183,340 | A * | 1/1980 | Gilbert | F02P 15/10 123/606 |
| 4,915,087 | A * | 4/1990 | Boyer | F02P 7/035 123/620 |
| 5,868,115 | A * | 2/1999 | Fukui | F02P 15/006 123/406.55 |
| 5,947,093 | A * | 9/1999 | Ward | F02P 3/04 123/169 EL |
| 6,018,202 | A * | 1/2000 | Meinders | F02P 3/0435 307/10.6 |
| 6,328,025 | B1 | 12/2001 | Marrs | |
| 2006/0164196 | A1 * | 7/2006 | Skinner | F02P 15/08 336/90 |
| 2009/0126710 | A1 | 5/2009 | Alger, II et al. | |
| 2012/0160222 | A1 | 6/2012 | Grady | |
| 2012/0186568 | A1 * | 7/2012 | Steinberger | F02P 13/00 123/634 |
| 2014/0102412 | A1 * | 4/2014 | Czekala | F02P 3/04 123/406.12 |

* cited by examiner

*Primary Examiner* — Hai Huynh
*Assistant Examiner* — Arnold Castro
(74) *Attorney, Agent, or Firm* — Julia Voutyras; McCoy Russell LLP

(57) ABSTRACT

A dual coil ignition system is provided. The dual coil ignition system includes a first inductive ignition coil including a first primary winding and a first secondary winding, and a second inductive ignition coil including a second primary winding and a second secondary winding, the second secondary winding connected in series to the first secondary winding. The dual coil ignition system further includes a diode network including a first diode and a second diode connected between the first secondary winding and the second secondary winding.

19 Claims, 7 Drawing Sheets

DUAL COIL IGNITION SYSTEM

GOVERNMENT RIGHTS

This invention was made with government support under DE-EE0003332 awarded by the Department of Energy. The government has certain rights in the invention.

FIELD

The present disclosure relates to a dual coil ignition system for controlling spark energy provided to a spark plug of an engine.

BACKGROUND AND SUMMARY

Engine systems may be configured with boosting devices, such as turbochargers or superchargers, for providing a boosted aircharge and improving peak power outputs. Responsive to the boosted output provided by such engine systems, efficient operation of a spark plug and stable combustion may be achieved by providing high peak secondary currents at high speed and high load conditions, while providing long spark durations at low speeds and loads under lean and/or dilute conditions. However, high peak secondary currents and long spark durations are competing characteristics for ignition coil configuration, resulting in systems that devalue operation under one or more of the above-identified conditions in favor of another condition.

The inventors have recognized the issues with the above approach and offer a system to at least partly address them. In one embodiment, a system comprises a first inductive ignition coil including a first primary winding and a first secondary winding and a second inductive ignition coil including a second primary winding and a second secondary winding. The second secondary winding is connected in series to the first secondary winding. The system further comprises a diode network including a first diode and a second diode connected between the first secondary winding and the second secondary winding.

In this way, each the two coils may be configured for a different one of the competing characteristics (e.g., high peak secondary currents or long spark duration), and steering diodes combine the output of each coil such that additional spark energy is only provided when operating conditions warrant.

The present disclosure may offer several advantages. For example, by only providing long spark duration when operating conditions call for additional spark energy, overall electrical energy consumption may be decreased in comparison to systems that always provide long spark duration. Further, the configuration decreases component stress, thereby extending component life span, by exposing the current steering diodes to a much lower maximum voltage in comparison to diodes utilized in parallel connected dual coil ignition systems. Furthermore, the lower maximum voltage enables compact coil packaging of a plug top coil positioned on top of a pencil or stick coil, thereby decreasing packaging real estate requirements on the engine in comparison to dual coil systems that are constructed with two side by side plug top coils in one housing or two separate coil packages.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

A dual coil ignition system having secondary windings connected in series via a current steering diode network is disclosed herein. The series-connection of the two ignition coils enables efficient control by allowing independent control of start of dwell times, while ending dwell for each ignition coil simultaneously with a single command. By connecting a relatively low inductance ignition coil to a relatively high inductance ignition coil, the resulting configuration provides high peak secondary currents and long spark duration based on combustion conditions.

Figure 1:
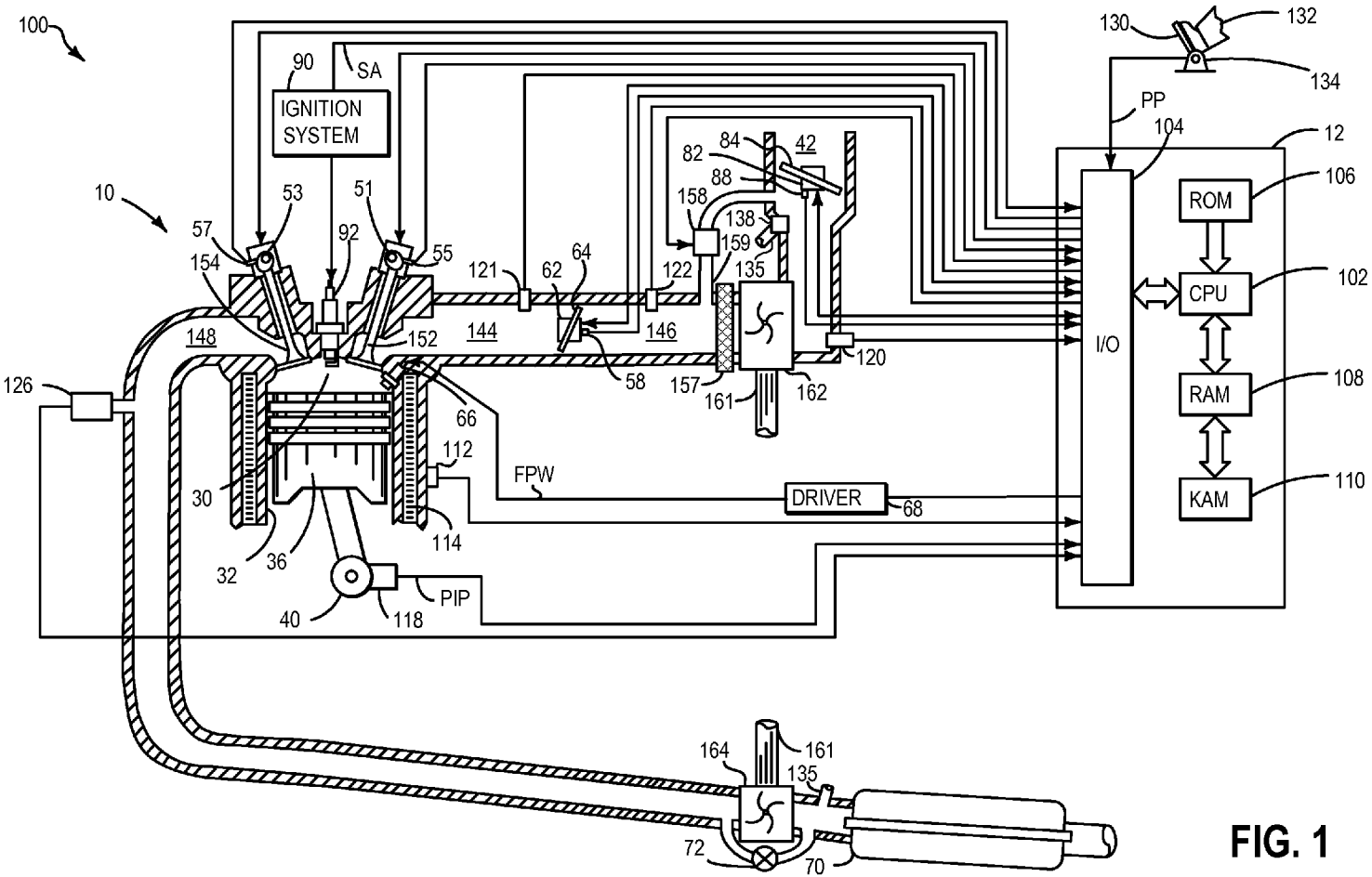
FIG. 1 is a schematic diagram of an engine.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12. Engine 10 includes combustion chamber 30 and cylinder walls 32 with piston 36 positioned therein and connected to crankshaft 40. Combustion chamber 30 is shown communicating with intake manifold 144 and exhaust manifold 148 via respective intake valve 152 and exhaust valve 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In addition, intake manifold 144 is shown communicating with optional electronic throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the boost chamber 146.

In some embodiments, engine 10 is configured to provide exhaust gas recirculation, or EGR. When included, EGR is provided via EGR passage 135 and EGR valve 138 to the engine air intake system at a position downstream of air intake system (AIS) throttle 82 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Compressor 162 draws air from air intake passage 42 to supply boost chamber 146. In some examples, air intake passage 42 may include an air box (not shown) with a filter. Exhaust gases spin turbine 164 which is coupled to compressor 162 via shaft 161. A vacuum operated wastegate actuator 72 allows exhaust gases to bypass turbine 164 so that boost pressure can be controlled under varying operating conditions. In alternate embodiments, the wastegate actuator may be pressure or electrically actuated. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in passage 146, downstream of compressor 162, for cooling the boosted aircharge delivered to the engine intake. In the depicted example, compressor recirculation path 159 is configured to recirculate cooled compressed air from downstream of charge air cooler 157 to the compressor inlet. In alternate examples, compressor recirculation path 159 may be configured to recirculate compressed air from downstream of the compressor and upstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Figure 2:
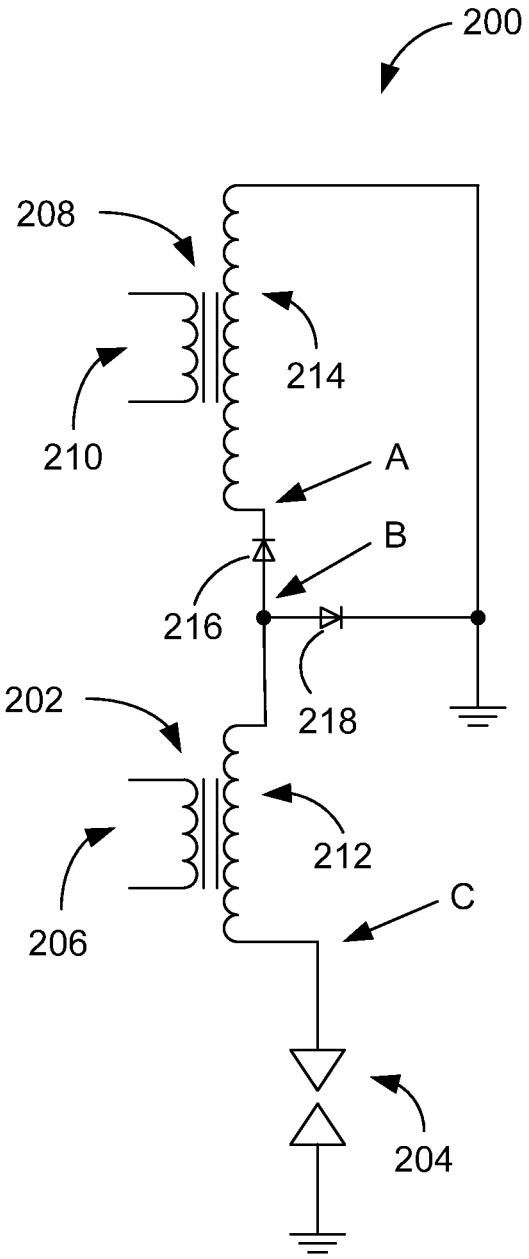
FIG. 2 shows a diagram of a dual coil ignition system in accordance with an embodiment of the present disclosure.

Distributorless ignition system 90 provides an ignition spark to combustion chamber 30 via spark plug 92 in response to controller 12. The ignition system 90 may include a dual induction coil ignition system, in which two ignition coil transformers are connected to each spark plug of the engine. Turning briefly to FIG. 2, an example of a dual coil ignition system 200 in accordance with embodiments of the present disclosure is illustrated, which may be used with the engine of FIG. 1. First ignition coil 202 may be a low inductance transformer, configured for providing high peak secondary current to spark plug 204. The first ignition coil 202 may be dwelled and fired, responsive to an encoded dwell command provided to primary windings 206, for every cylinder event near the end of the compression stroke in some embodiments. For example, the first ignition coil 202 is dwelled as current is passed through the primary windings 206, generating a magnetic field. The first ignition coil 202 is fired due to the cessation or interruption of current passing through the primary windings 206, causing a collapse in the magnetic field and a high voltage pulse across secondary windings 212 of the first ignition coil 202. Second ignition coil 208 may be a high inductance transformer, having a higher inductance than the first ignition coil 202, configured for providing long spark duration for spark plug 204. The second ignition coil 208 may thus be dwelled and fired, responsive to an encoded dwell command provided to primary windings 210, to augment the first ignition coil 202 under selected combustion conditions. As shown in FIG. 2, the secondary windings 212 and 214 of the first and second ignition coils, respectively, are connected in series through a diode network including current steering diodes 216 and 218.

The current steering diodes 216 and 218 may be configured to ensure that the energy stored in the second ignition coil 208 is maintained until the contribution of the stored energy to the spark plug 204 is most effective for aiding combustion. For example, the diode network may be configured such that the second ignition coil 208 contributes stored energy to the spark plug 204 when the current through the first ignition coil 202 decays to a level corresponding and/or equivalent to the peak secondary current in the second ignition coil 208 as determined by its state of charge at the end of dwell. The second ignition coil 208 may be configured for a peak current through the secondary windings 214 that is a fraction of the peak current through the secondary windings 212 of the first ignition coil 202. Accordingly, as the current through the secondary windings 212 decays to the peak current of the secondary windings 214, the junction at the anodes of diodes 216 and 218, identified as point B in FIG. 2, becomes more negative than a source voltage applied to the primary windings 210, causing current flow through diode 218 to cease. As current flow through diode 218 ceases, energy from the secondary windings 214 of the second ignition coil 208 is added to a glow phase discharge at the spark plug. Accordingly, discharge of the energy stored at the second ignition coil 208 may be controlled automatically via the diode network without a separate signal from a controller.

As referenced in FIG. 2, point A corresponds to an output of the secondary windings 214 of the second ignition coil 208, point B corresponds to the junction of the anodes of diodes 216 and 218, and point C corresponds to an output of the secondary windings 212 of the first ignition coil 202. During dwell, the outputs of the secondary windings 212 and 214, represented by points A and C, are positive, while the junction of the anodes of diodes 216 and 218 is negative. Upon firing the low inductance coil, first ignition coil 202, point A remains positive, while point B changes to ground and point C changes to negative. As the current through the secondary windings 212 decays, points A, B, and C become negative, as the secondary windings 214 provide energy to the spark plug 204. Accordingly, diode 216 may be configured to withstand a maximum voltage equal to the combined maximum voltage expected across secondary windings 212 and 214 during the dwell of coils 202 and 208. Diode 218 may be configured to withstand a maximum voltage equal to the greater of the maximum voltage expected across the secondary windings 212 during the dwell of coil 202 and the maximum voltage expected during the glow phase of the spark plug 204.

Returning to FIG. 1, Universal Exhaust Gas Oxygen (UEGO) sensor 126 is shown coupled to exhaust manifold 148 upstream of catalytic converter 70. Alternatively, a two-state exhaust gas oxygen sensor may be substituted for UEGO sensor 126. Converter 70 can include multiple catalyst bricks, in one example. In another example, multiple emission control devices, each with multiple bricks, can be used. Converter 70 can be a three-way type catalyst in one example. While the depicted example shows UEGO sensor 126 upstream of turbine 164, it will be appreciated that in alternate embodiments, UEGO sensor may be positioned in the exhaust manifold downstream of turbine 164 and upstream of convertor 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator pedal position (PP) adjusted by a foot 132 of a vehicle operator; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 30 via intake manifold 144, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 152 and exhaust valve 154 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is described merely as an example, and that intake and exhaust valve opening and/or closing timings may vary, such as to provide positive or negative valve overlap, late intake valve closing, or various other examples.

Figure 3:
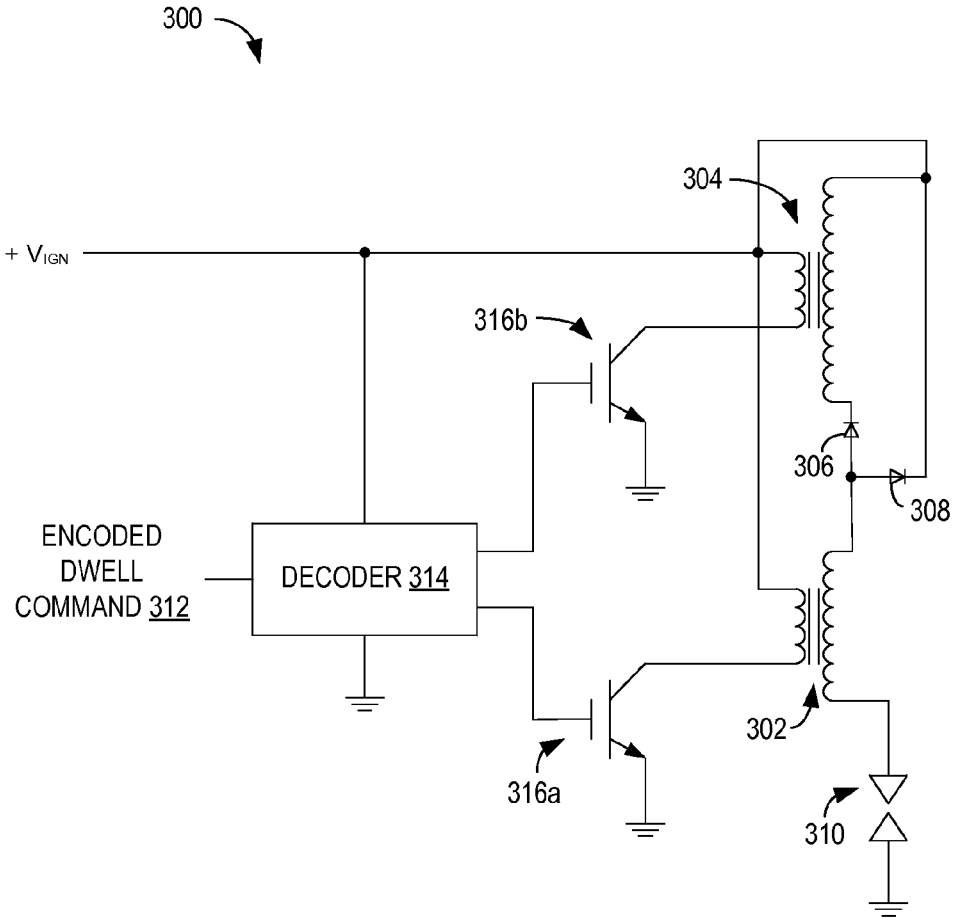
FIG. 3 shows a detailed diagram of a dual coil ignition system in accordance with an embodiment of the present disclosure.

FIG. 3 shows a detailed diagram of a dual coil ignition system 300 that may be used with an engine, such as the engine of FIG. 1. Ignition system 300 includes a first ignition coil 302, configured similarly to first ignition coil 202 of FIG. 2, and a second ignition coil 304, configured similarly to second ignition coil 208 of FIG. 2. For example, the first ignition coil 302 may have a lower inductance than the second ignition coil 304. The output of the first ignition coil 302 is communicatively connected to spark plug 310. A positive input of the primary windings of both the first ignition coil 302 and the second ignition coil 304 is connected to an ignition voltage source, identified in FIG. 3 as $+V_{IGN}$. For example, $V_{IGN}$ may be provided by a battery or any other suitable electrical power source. The node at the cathode end of diode 308 may be either tied to +Vign as shown or to ground as shown at the cathode end of diode 218 in FIG. 2. In either configuration, the position and orientation of the diodes enables the diodes to control the flow of current by blocking current flow from secondary windings of the second ignition coil 304 until the junction of the anodes of diodes 306 and 308 becomes more negative than a source voltage.

An encoded dwell command 312 may be utilized to control the flow of current through each of the first and second ignition coils 302 and 304, thereby controlling the associated dwell and fire of the coils. The encoded dwell command 312 may allow a single conductor and/or signal source to supply multiple commands that are differentiated based on pulse widths and/or other encoded features. For example, a first pulse width may indicate a command for a start of dwell for a first ignition coil, and a second pulse width may indicate a command for a start of dwell for a second ignition coil. As illustrated, the encoded dwell command 312 and $V_{IGN}$ may be communicatively connected to a decoder 314. The decoder 314 may also be communicatively connected to a solid-state device, such as transistors 316*a* and 316*b*, for establishing and disrupting the current flow to the primary windings of the first and second ignition coils 302 and 304 based on the encoded dwell command 312. The decoder 314 and transistors 316*a* and 316*b* may form an intelligent driver for dwell control of the ignition coils, including interpretive logic to decode the dwell commands provided for control of the ignition coils.

The decoder 314 may include a processor communicatively connected to a memory device. The processor may be configured to execute computer- and/or machine-readable instructions stored on the memory device to perform operations such as the decoding and dwell control described herein. The decoder 314 may include instructions executable to evaluate an encoded dwell command in order to determine whether the current flow to the first ignition coil and/or the second ignition coil should change state. For example, the decoder 314 may determine a rising edge of an encoded dwell command generated in response to a desired start of dwell based on engine speed, load, and/or other parameters. Responsive to detecting the rising edge, the decoder 314 may wait for a predetermined amount of time after the rising edge is detected.

Upon expiration of the predetermined amount of time or after a falling edge is detected, the decoder 314 may determine whether a short pulse or a long pulse is detected. For example, if a falling edge was detected prior to the expiration of the predetermined amount of time, the decoder 314 may determine that the encoded dwell command comprised a short pulse, whereas an expiration of the predetermined amount of time without detection of a falling edge may indicate a long pulse. Responsive to a short pulse, the decoder 314 may initiate and/or increase current flow to the second ignition coil 304 by connecting transistor 316*b* to the voltage source $+V_{IGN}$. For example, the decoder 314 may include a switching element that controls a connection between the gate of the transistors and the voltage source. Responsive to a long pulse, the decoder 314 may initiate and/or increase current flow to the first ignition coil 302 by connecting transistor 316*a* to the voltage source. Upon detecting a falling edge of a long pulse, the decoder 314 may stop and/or decrease current flow to the first and second ignition coils by disconnecting transistors 316*a* and 316*b* from the voltage source $V_{IGN}$. In some embodiments, transistors 316*a* and 316*b* may be insulated-gate bipolar transistors (IGBTs), which exhibit increased efficiency and switching times in comparison to other transistor configurations. The decoder may comprise a logic unit with instructions and operators formed therein for decoding encoded signals, as described herein.

Figure 4:
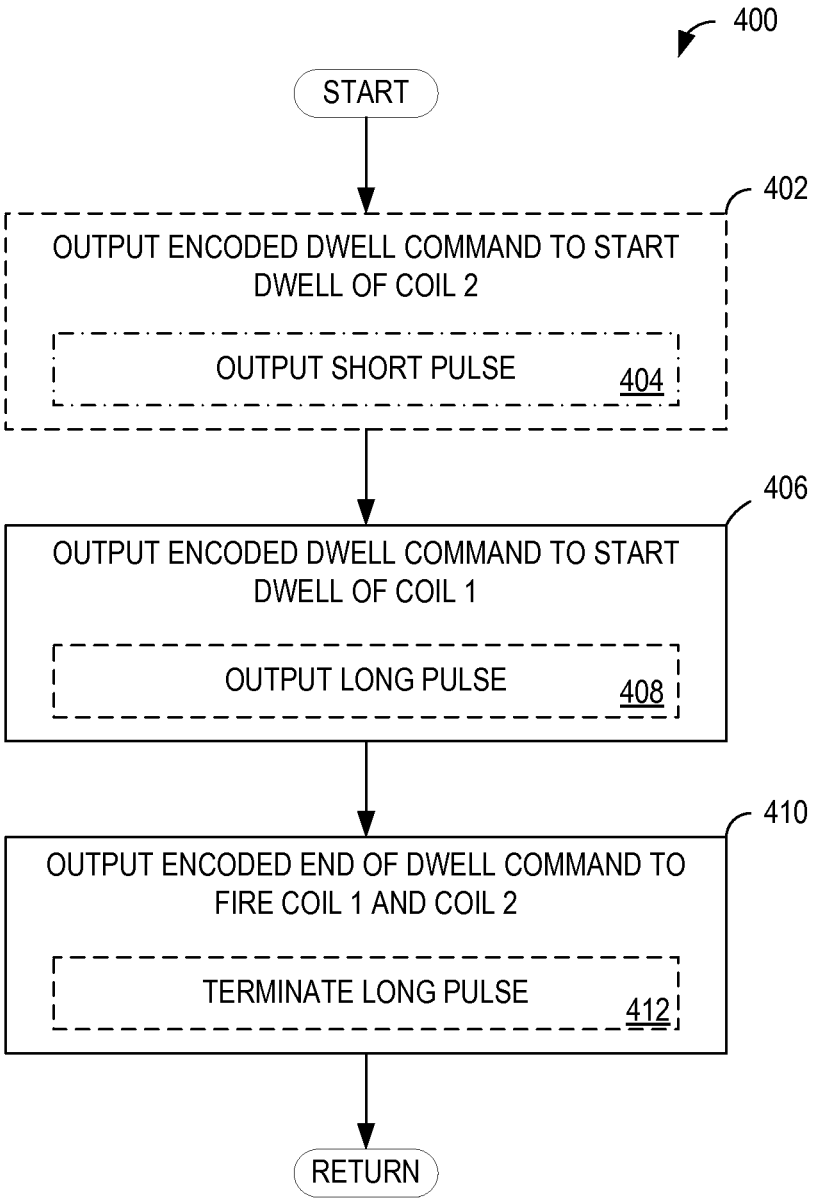
FIG. 4 is a flow diagram of a method of controlling ignition coils.

FIG. 4 is a flow diagram of a method 400 for controlling ignition coils in cooperation with the configuration of FIG. 2 or 3, and therefore spark generation, in an engine, such as the engine of FIG. 1. For example, the method 400 may be performed by the controller 12 of FIG. 1 and detected by the decoder 314 of FIG. 3. At 402, the method 400 optionally includes outputting an encoded dwell command to control a second, higher inductance ignition coil, such as second ignition coil 208 of FIG. 2 and/or second ignition coil 304 of FIG. 3. As indicated at 404, the encoded dwell command may include a short pulse, such that the controller may output the short pulse to signal a start of dwell for the second ignition coil. For example, the short pulse may be 75 μs or shorter in duration, and the start of dwell of the second ignition coil may occur at some point after the falling edge of the short pulse is detected.

The second ignition coil may only be dwelled during operating conditions that benefit from the extended spark duration provided by the second, higher inductance ignition coil. For example, during high RPM and/or high load conditions, the output of a first, lower inductance ignition coil may be sufficient to provide reliable combustion, and the method 400 may proceed directly to 406 without outputting an encoded dwell command to start the dwell of the second ignition coil.

At 406, the method 400 includes outputting an encoded dwell command to start the dwell of a first, lower inductance ignition coil. For example, the first ignition coil may correspond to first ignition coil 202 of FIG. 2 and/or first ignition coil 302 of FIG. 3. As indicated at 408, the encoded dwell command may include a long pulse, such that the long pulse is output to indicate a start of dwell for the first ignition coil. The long pulse may be 150 μs or greater in duration, and/or any suitable value that is greater than the short pulse for signaling start of dwell for the second ignition coil. In some embodiments, the long pulse may include a confirmation period, such that the start of dwell of the first ignition coil may be delayed to occur after the confirmation period has elapsed, rather than immediately upon detection of the rising edge of the long pulse. The confirmation period may have a duration that is longer than the duration of the short pulse, such that the long pulse may be differentiated from the short pulse before starting dwell of the first ignition coil.

During the commanded dwell, current is passed through the primary windings of the first and/or second ignition coils to generate a magnetic field. At 410, the method 400 further includes outputting an encoded end of dwell command to fire the first and the second ignition coils. The end of dwell command may include a termination of the long pulse, as indicated at 412. For example, the current flow through the primary windings of the first and/or second ignition coil may be interrupted and/or stopped responsive to detecting the falling edge of the long pulse. The interruption of the current flow through the primary windings causes a high voltage pulse across the respective secondary windings of the ignition coils. In configurations such as the ignition systems 200 and/or 300, illustrated in FIGS. 2 and 3, respectively, the direct connection of the secondary windings of the first ignition coil to the spark plug allows the first ignition coil to provide a high peak secondary current to the spark plug immediately upon interrupting the current flow through the associated primary windings. Likewise, the diode network illustrated in both FIGS. 2 and 3 allows the second ignition coil to store energy until the current through the secondary windings of the first ignition coil has decayed to the level of peak secondary current in the second ignition coil. Accordingly, a single command may be utilized to control the firing of both ignition coils, while still providing a delay of discharge of a second ignition coil with respect to the first ignition coil. In this way, the second ignition coil may deliver additional spark energy only when combustion conditions warrant and without a separately-controlled fire command signal.

Figure 5:
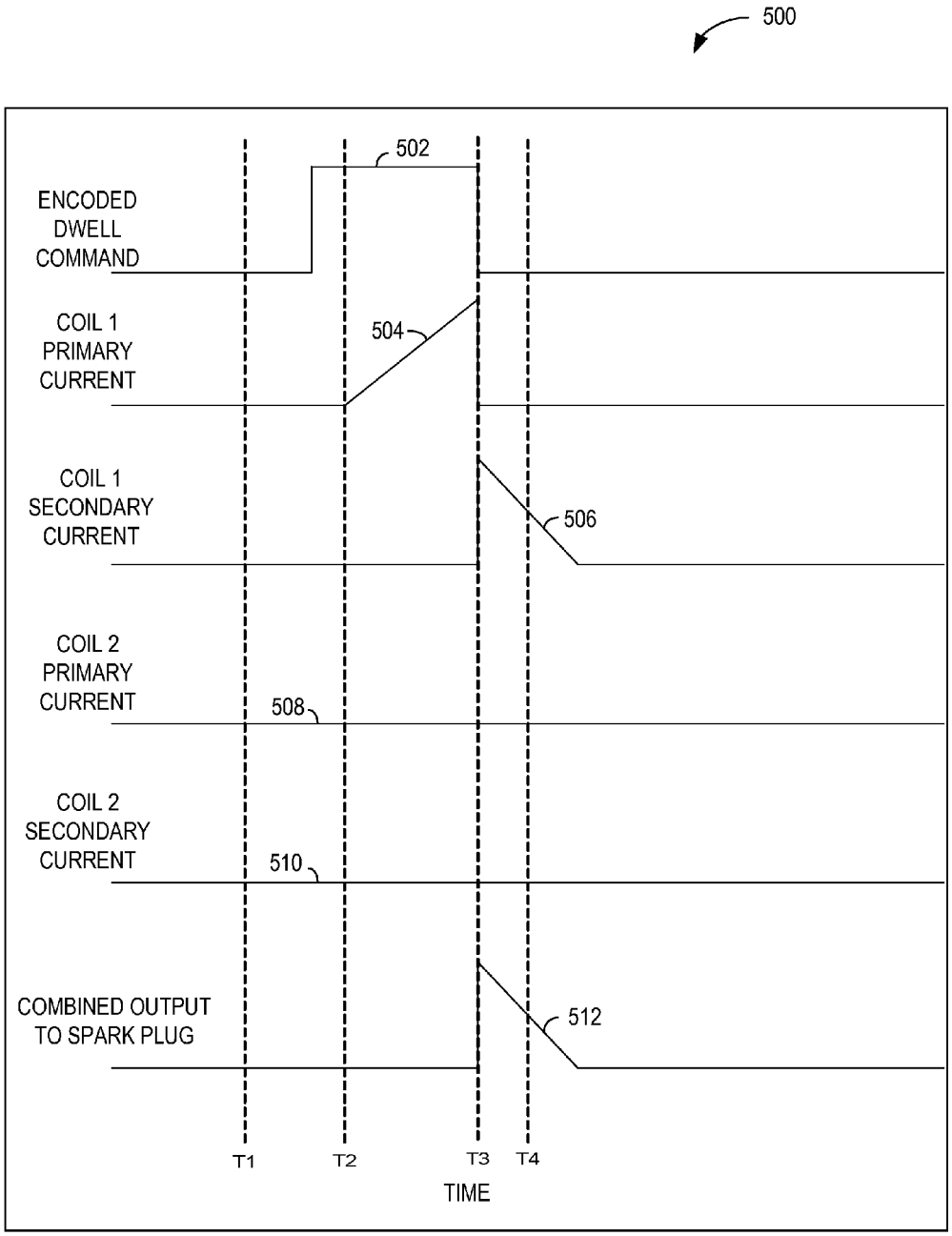
FIGS. 5 and 6 show waveforms of the operation of the first and second ignition coils responsive to an encoded dwell command
Figure 6:
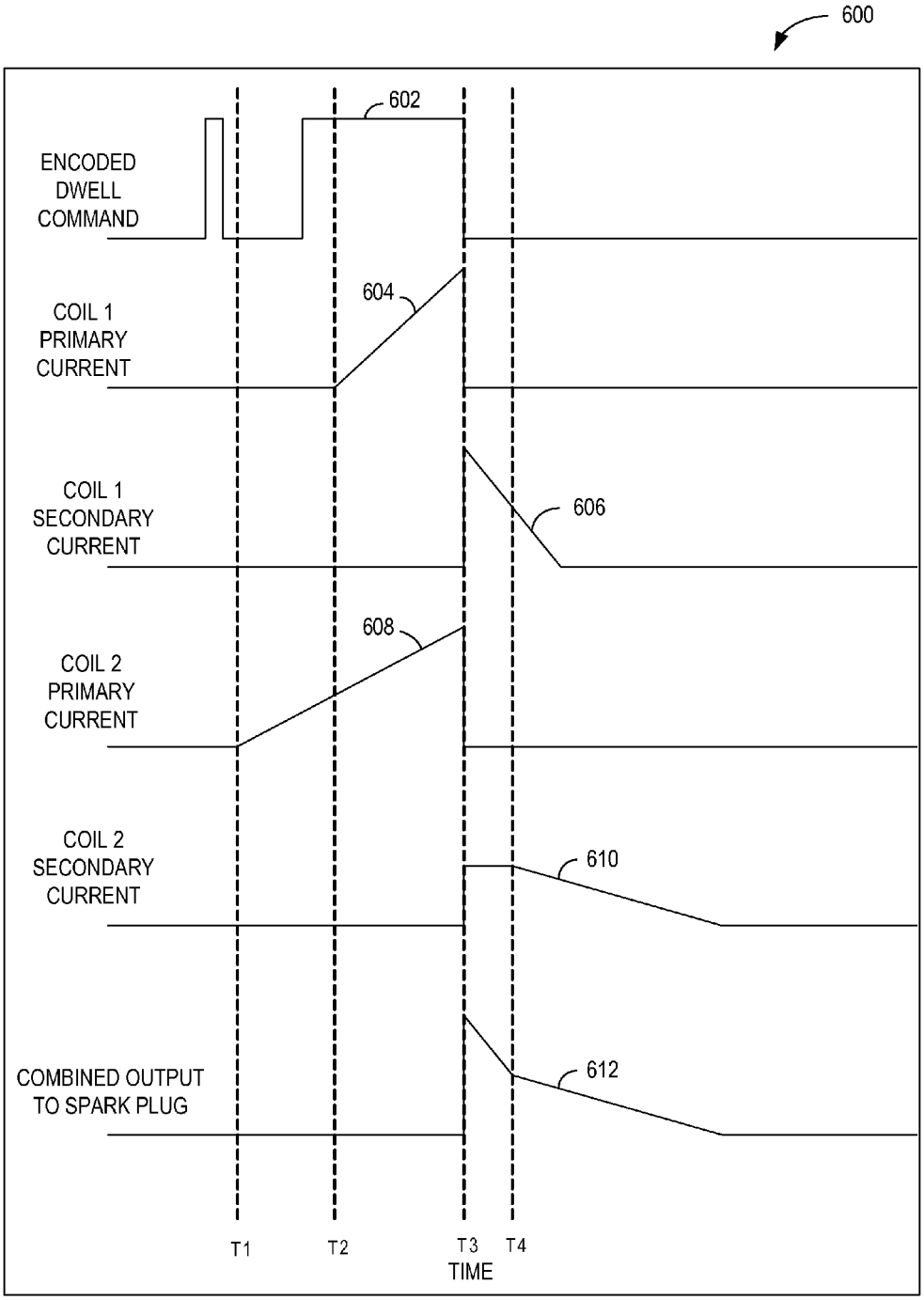

FIGS. 5 and 6 illustrate waveforms reflecting the operation of the first and second ignition coils described herein responsive to an encoded dwell command, and the effect of such operation on energy applied to a spark plug. In the illustrated waveforms, the x-axes correspond to a shared timeline, while each y-axis corresponds to the parameter indicated adjacent to the associated waveform. The secondary current flow into the ignition coils from the spark plug is depicted in the positive direction in each figure. In FIG. 5, waveforms 500 show operation of the first and second ignition coils responsive to the dwelling and firing of only the first ignition coil. For example, the waveforms 500 may result from the execution of steps 406 through 412 of the method 400 illustrated in FIG. 4.

Waveform 502 corresponds to an encoded dwell command, which may be provided from a controller, such as controller 12 of FIG. 1. Waveforms 504 and 506 correspond to primary and secondary currents, respectively, flowing through a first ignition coil, such as first ignition coil 202 of FIG. 2 and/or first ignition coil 302 of FIG. 3. Waveforms 508 and 510 correspond to primary and secondary currents, respectively, flowing through a second ignition coil, such as second ignition coil 208 of FIG. 2 and/or first ignition coil 304 of FIG. 3. Waveform 512 corresponds to the combined output to the spark plug, such as current supplied to the spark plug 204 of FIG. 2 and/or the spark plug 310 of FIG. 3.

At time T1, the encoded dwell command is at low or ground, resulting in the absence of current through each of the windings of the two ignition coils. Accordingly, the combined output to the spark plug 512 may also be equal to zero. At time T2, however, the encoded dwell command has been issued for a period of time, as indicated by the rising edge and associated duration at a high value illustrated on waveform 502. For example, time T2 may correspond to a threshold period of time after the rising edge of a long pulse encoded dwell command. The threshold period of time may be associated with a confirmation time, utilized to ensure that a "start of dwell" command for the first ignition coil is intended, as opposed to a short pulse, noise, and/or other signal. In some examples, time T2 may correspond to a moment in time 150 μs after the leading edge of the encoded dwell command. Accordingly, as shown on waveform 504, the current through the primary windings of the first ignition coil increases responsive to a threshold period of time elapsing after the rising edge of the encoded dwell command is detected. As described above, the second ignition coil is commanded to dwell responsive to a short pulse, rather than a long pulse, therefore waveforms 508 and 510 do not change at time T2. Likewise, the increase in current at the primary windings of the first ignition coil generates a magnetic field, but does not affect a current through the secondary windings of the first ignition coil, such current flow being blocked by diodes 216 and 218 in FIG. 2 or diodes 306 and 308 in FIG. 3, therefore the waveforms 506 and 512 also remain unchanged at time T2.

At time T3, however, the falling edge of the encoded dwell command occurs, as illustrated in waveform 502. As this signals the firing of the first ignition coil, the current in the primary windings is interrupted, falling to zero as shown on 504. In response, the magnetic field generated due to the prior current flow in the primary windings of the first ignition coil collapses, inducing a voltage pulse across the secondary windings of the first ignition coil and the peak current output illustrated on waveform 506 at time T3. As no magnetic field was generated in the second ignition coil, waveforms 508 and 510 remain unchanged, and the combined output to the spark plug is equivalent to the secondary current of the first ignition coil. At time T4, the current continues to be discharged from the secondary windings, providing a corresponding output to the spark plug. As the second ignition coil does not contribute to the combined output, the spark plug experiences the high peak current and short spark duration characterized by the configuration of the first ignition coil.

FIG. 6 illustrates example waveforms 600 corresponding to operations in which a second ignition coil is dwelled and fired in order to contribute to the output to the spark plug. In the illustrated embodiment, time T1 corresponds to a time shortly after an encoded dwell command 602 produces a short pulse. For example, time T1 may correspond to a threshold duration of time after a falling edge of a short pulse is detected. Accordingly, the threshold duration of time may correspond to a confirmation period for verifying that the encoded dwell command corresponds to a short pulse. Responsive to the short pulse and/or the completion of the threshold duration of time after the falling edge of the short pulse, current flow 608 through a second, higher inductance, ignition coil increases with the start of dwell of the coil. As the short pulse signifies a command for a second, higher inductance, ignition coil, rather than a first, lower inductance, ignition coil, the primary and secondary currents of the first ignition coil, shown at 604 and 606, respectively, remain unchanged. The second ignition coil has not been fired, therefore the secondary windings of the second ignition coil experience no current flow, as illustrated at 610. Accordingly, the combined output to the spark plug 612 remains unchanged.

Time T2 of FIG. 6 corresponds to time T2 of FIG. 5, thereby resulting in the start of dwell of the first ignition coil illustrated at 604. As the start of the long pulse and associated confirmation period corresponds to a command for the first ignition coil, rather than the second ignition coil, the primary windings of the second ignition coil continue dwelling without being affected by the detection of the long pulse.

At time T3, the falling edge of the long pulse is detected. As illustrated in waveforms 604 and 608, the current flow in the primary windings of both the first ignition coil and the second ignition coil is interrupted as the associated coils are fired simultaneously. In response, the secondary currents of the first and second ignition coils are raised to a respective peak value. For example, as the first ignition coil is configured for high peak currents, the secondary current 606 at coil 1 at time T3 may be higher than the secondary current 610 at coil 2 at time T3. Due to the diode network and series-connected secondary windings illustrated in FIGS. 2 and 3, current through the secondary windings of ignition coil 1 flows through both a second diode, such as diode 308 of FIG. 3, and the second ignition coil. Accordingly, the magnetic flux of the second ignition coil is maintained at an initial end of dwell level between times T3 and T4, as the voltage across the secondary windings of the second ignition coil is approximately zero. The energy stored in the second ignition coil is not contributed to the spark plug during this time, so the combined output to the spark plug corresponds to the secondary current of the first ignition coil.

At time T4, the secondary current of the first ignition coil decays to the level of the peak secondary current of the second ignition coil, as shown by the equivalent levels of waveforms 606 and 610 at time T4. Accordingly, the junction of the anodes of diodes 306 and 308 of FIG. 3, for example, becomes more negative than a source voltage, and current flow through diode 308 ceases. In response, all current flows through both ignition coils and the second ignition coil adds the energy stored therein to the energy provided by the first ignition coil to the spark plug. As shown from time T4 an onward, the contribution from the secondary coil slows the decay of output to the spark plug such that spark duration is increased in comparison to the spark duration illustrated by waveform 512 of FIG. 5. The amount and timing of energy provided to the spark plug by the second ignition coil is dependent upon the storage of magnetic flux in the second ignition coil, which is determined by the configuration of the second ignition coil and the duration of dwell. Accordingly, the amount and timing of energy provided to the spark plug may be adjusted by changing a start of dwell time of the second ignition coil in reference to a start of dwell time and/or end of dwell time of the first ignition coil.

Figure 7:
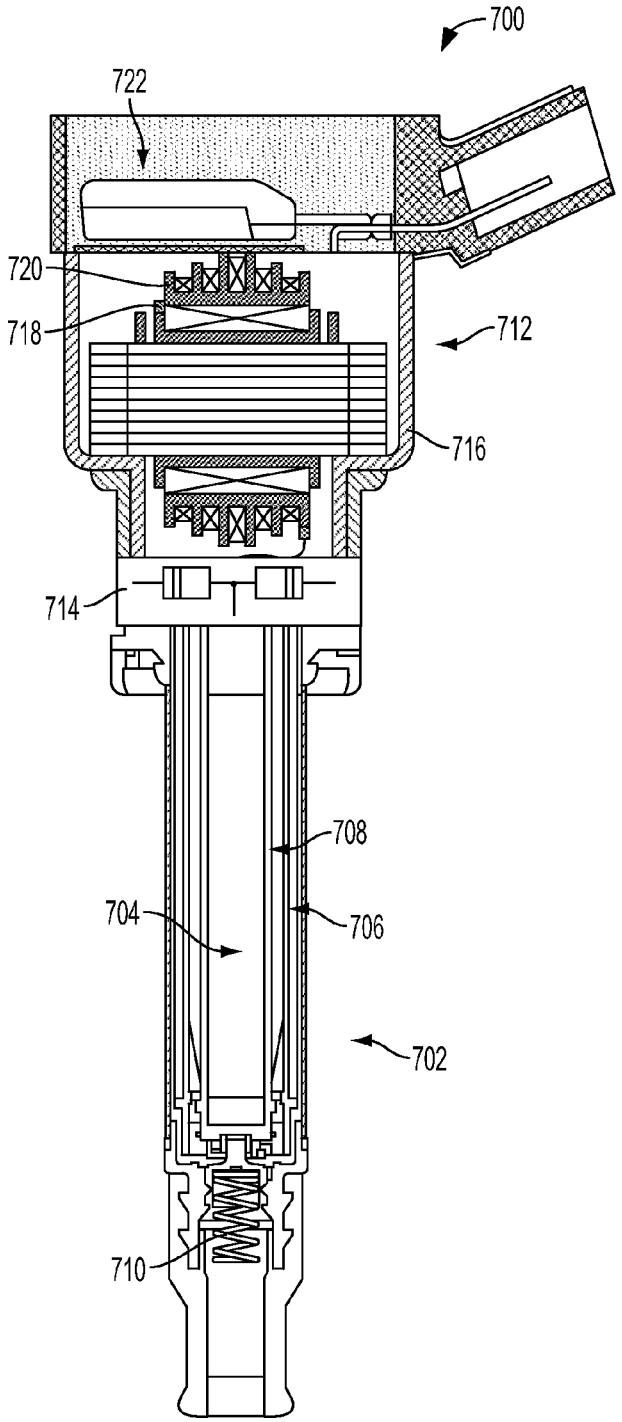
FIG. 7 shows a schematic diagram of a packaging for a dual coil ignition system in accordance with an embodiment of the present disclosure.

FIG. 7 illustrates an example packaging 700 for one or more of the dual coil ignition systems described above. In current practice, low inductance ignition coils may be constructed as a "pencil" or "stick" coil configuration, which is long, thin, and configured to fit into a spark plug well tube leading through a cam cover or valve cover of an engine to a spark plug. High inductance ignition coils, may be constructed as a "plug top" coil configuration, resembling some other transformer packaging configurations. The plug top coil configurations may be cube-shaped and mounted on top of a spark plug well via a long spring encased in a rubber boot. In dual coil ignition systems having secondary windings connected in parallel, the maximum output of the high inductance ignition coil in a plug top configuration is too high to allow the output to be routed alongside the body of a pencil coil configuration to the top of the spark plug. The above-described systems and methods, in which the secondary windings are connected in series, ensure that the maximum output of the high inductance ignition coil is much lower and is contained at the top of the pencil coil, not needing to be routed to the top of the spark plug. For example, a parallel-connected dual coil configuration may experience a maximum output of minus 40,000 volts, while the present configuration may provide a maximum potential of plus and minus 1,500 volts at start of dwell and be governed by a maximum glow phase voltage during discharge of the coils with peaks of less than minus 6,000 volts. The lower maximum voltage stress of series-connected configurations may be contained and isolated at the top of the pencil coil in comparison to parallel-connected configurations.

Accordingly, a series-connected configuration, such as the configurations illustrated in FIG. 2 and/or 3, may utilize a combined plug top and pencil coil configuration that provides more compact packaging in comparison to two side-by-side plug top coil configurations. As shown in FIG. 7, a low inductance ignition coil 702 is provided with a pencil coil configuration. The pencil coil configuration may include a rod-like center core 704 and a secondary winding 708 wound around the center core 704. The output of the secondary winding 708 may be provided to the spark plug via a spring 710. A prima winding 706 may be wound around outside of the secondary winding 708.

A high inductance ignition coil 712 may be configured as a plug top configuration and positioned above and/or on top of the pencil coil configuration of the low inductance ignition coil 702. The low inductance ignition coil 702 may be communicatively connected to the high inductance ignition coil 712 via a diode network 714. For example, the diode network 714 may include the diode configuration provided by diodes 306 and 308 of FIG. 3. The high inductance ignition coil 712 may include a coil housing 716, including a primary winding 718 and a secondary winding 720 therein. An intelligent driver 722 for dwell control of the two ignition coils 702 and 712 may be positioned above and/or directly on top of or on the side of the high inductance ignition coil 712. For example, the intelligent driver 722 may correspond to the decoder 314 and associated transistors 316*a* and 316*b* of FIG. 3.

The above-described packaging thereby provides the high peak secondary current and efficient usage of spark plug well space, associated with the pencil coil, and the long spark duration, achieved with a plug top configuration, within a single package. Accordingly, the series-connected dual coil ignition system not only provides an efficient control scheme and lower component stress, but also enables the use of a more compact packaging configuration than parallel-connected dual coil ignition systems.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a first inductive ignition coil including a first primary winding and a first secondary winding;

a second inductive ignition coil including a second primary winding and a second secondary winding, the second secondary winding connected in series to the first secondary winding;

a diode network including a first diode and a second diode connected between the first secondary winding and the second secondary winding; and a controller with instructions stored in memory to provide one or more dwell commands to control a flow of current through the first primary winding and the second primary winding.

2. The system of claim 1, further comprising a spark plug directly connected to an output of the first secondary winding.

3. The system of claim 1, wherein the one or more dwell commands is an encoded dwell command, the system further comprising a decoder configured to receive and decode the encoded dwell commands from the controller.

4. The system of claim 3, further comprising a first transistor communicatively connected to the decoder and the first primary winding and a second transistor communicatively connected to the decoder and the second primary winding.

5. The system of claim 4, wherein the first transistor and the second transistor are both insulated-gate bipolar transistors.

6. The system of claim 1, wherein the first diode is configured to flow current from the first ignition coil to the second ignition coil when energy from the first coil has decayed to a level of stored charge in the second ignition coil.

7. A system comprising:

a first and second ignition coil having a first and second secondary winding connected in series to one another; and a first and second diode connected to an output of the first secondary winding, the first diode connected to flow current from the first ignition coil to the second ignition coil when energy from the first coil has decayed to a level of stored charge in the second ignition coil.

8. The system of claim 7, further comprising a controller with instructions stored in memory to provide one or more dwell commands to control a flow of current through a first primary winding and a second primary winding.

9. The system of claim 8, wherein the one or more dwell commands is an encoded dwell command, the system further comprising a decoder configured to receive and decode the encoded dwell commands from the controller.

10. The system of claim 9, wherein the second ignition coil is configured as a plug top coil and the first ignition coil is configured as a pencil coil.

11. The system of claim 10, wherein the second ignition coil is positioned on top of the first ignition coil, the first ignition coil being communicatively connected to the second ignition coil via a diode network including the first and second diodes.

12. A method comprising:

outputting a first command to introduce a first current through a first ignition coil;

outputting a second command to introduce a second current through a second ignition coil;

terminating the first command; and interrupting the first current and the second current responsive to the termination of the first command.

13. The method of claim 12, wherein the first command is a long pulse and the second command is a short pulse, the first pulse being longer than the second pulse.

14. The method of claim 13, wherein the termination of the first command is detected by a falling edge of the long pulse.

15. The method of claim 13, wherein a duration of the long pulse is 150 microseconds or greater.

16. The method of claim 13, wherein a duration of the short pulse is 75 microseconds or less.

17. The method of claim 12, wherein at least one of the first command and the second command is an encoded dwell command, the method further comprising only providing longer spark duration responsive to a request for additional spark energy based on current engine operating conditions.

18. The method of claim 12, further comprising interrupting the first current and the second current responsive to completion of an extended time duration after the start of the first command.

19. The method of claim 12, further comprising interrupting the second current and ceasing current flow through a second primary winding of the second ignition coil responsive to completion of an extended time duration after the start of the second command.

* * * * *